US006342338B1

(12) United States Patent
Verbeeck et al.

(10) Patent No.: US 6,342,338 B1
(45) Date of Patent: Jan. 29, 2002

(54) SILVER HALIDE PHOTOGRAPHIC MATERIAL EXHIBITING INCREASED COVERING POWER AND "COLDER" BLUE-BLACK IMAGE TONE

(75) Inventors: Ann Verbeeck, Begijnendijk; Govert Wim De Baecke, Kalken; Johan August Loccufier, Zwijnaarde; Freddy Henderickx, Olen, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/710,838

(22) Filed: Nov. 14, 2000

Related U.S. Application Data

(60) Provisional application No. 60/169,266, filed on Dec. 7, 1999.

(30) Foreign Application Priority Data

Nov. 26, 1999 (EP) ..... 99204010

(51) Int. Cl.[7] ..... G03C 1/35; G03C 1/46; G03C 5/16; G03C 5/17

(52) U.S. Cl. ..... 430/502; 430/139; 430/368; 430/523; 430/539; 430/564; 430/567; 430/965; 430/966; 430/967

(58) Field of Search ..... 430/139, 368, 430/502, 965, 966, 967, 523, 539, 564, 567

(56) References Cited

U.S. PATENT DOCUMENTS 2,848,329 A 8/1958 Chechak et al.
5,190,855 A 3/1993 Toya et al.
5,700,630 A 12/1997 Inoue et al.

FOREIGN PATENT DOCUMENTS

EP 0 575 262 A2 12/1993
EP 0 911 687 A1 4/1999
EP 0 933 670 A1 8/1999

*Primary Examiner*—Richard L. Schilling
(74) *Attorney, Agent, or Firm*—Breiner & Breiner, L.L.C.

(57) ABSTRACT

A black-and-white silver halide photographic film material, particularly suitable for use in radiography, has been disclosed, said material comprising a transparent film support having first and second major surfaces coated with a subbing layer, further coated adjacent thereto on one side (for a single-side coated material) or on both sides (for a duplitized material) of said film support and overcoated with a protective antistress layer, a light-sensitive silver halide emulsion layer having chemically and spectrally sensitized {111} tabular hexagonal grains, accounting for at least 50% of the total projective surface of all grains, wherein said film material is coated with a low amount of silver and wherein said protective antistress layer(s)and/or another hydrophilic non-light-sensitive layer comprise(s) a compound according to general formula (I) in an amount of at least 0.5 mmole per mole of coated silver halide, as claimed.

A radiographic screen/film combination has also been disclosed, said combination comprising a duplitized film as described herein sandwiched between a pair of supported or self-supporting X-ray intensifying screens emitting radiation in the wavelength range for which said material has been made spectrally sensitive in order to obtain a black-and-white image after exposure of said screen/film combination, followed by processing of the film material.

12 Claims, No Drawings

SILVER HALIDE PHOTOGRAPHIC MATERIAL EXHIBITING INCREASED COVERING POWER AND "COLDER" BLUE-BLACK IMAGE TONE

This application claims benefit of provisional application No. 60/169,266, filed Dec. 7, 1999.

FIELD OF THE INVENTION

The present invention relates to a black-and-white light-sensitive silver halide photographic film material, particularly suitable for use in radiography and a combination of one or two intensifying luminescent phosphor screen(s) and said film material comprising in the light-sensitive emulsion layers hexagonal {111} tabular emulsion grains.

BACKGROUND OF THE INVENTION

Since the early eighties practical use of light-sensitive tabular silver halide grains or crystals has become common knowledge for anyone skilled in the art of photography. From Eastman Kodak's basic patents relied thereupon those related with the preparation of {111} tabular silver halide grains, sensitivity increase by spectral and chemical sensitization, and coating in a light-sensitive silver halide photographic material, more particularly in a forehardened duplitized radiographic material showing improved covering power for tabular grains having a thickness of less than 0.20 μm as described in U.S. Pat. No. 4,414,304 and in the patents corresponding therewith in Japan and in the European countries, it becomes clear that problems encountered by making use of such grains are related with image tone and developability as has also been set forth in U.S. Pat. No. 5,595,864.

In radiographic applications the film materials are coated with relatively high amounts of silver, in order to provide a suitable sensitometry even if a low radiation dose is applied to the patient as is always desirable. Although the use of {111} tabular silver halide grains permits coating of lower amounts of silver, if compared e.g. with grains having a more globular shape as applied before practical application of said tabular grains, there remains the need to provide an acceptable image tone after development of materials having light-sensitive silver halide layers containing said tabular grains. Reduction of thickness of the {111} tabular grains coated in a radiographic film material hitherto, although providing a higher covering power, remains unambiguously related indeed with the occurrence, after processing of such materials, of diagnostic images having an unacceptable reddish-brown image tone for radiologists as image tone and image quality are closely related with each other in the specific context of examination of diagnostic images. Providing tabular grains having a thickness of more than 0.20 μm, e.g. in the range from 0.21–0.23 μm, the preparation method of which has been described in EP-A 0 569 075 and in the corresponding U.S. Pat. No. 5,595,864, ensures a better image tone but this is at the cost of covering power as may be expected.

Measures taken in order to get a shift in image tone for whatever a grain thickness from reddish-brown to the desired bluish-black color of the developed silver, combined with a good covering power, are hitherto unsatisfactory. Coating light-sensitive emulsion layers on a blue base as in U.S. Pat. No. 5,800,976 makes increase minimum density, a phenomenon which is interpreted by the radiologist as an undesired increase of fog density. Incorporation in the other layers of the film material of such dyes or dye precursors providing blue color directly or indirectly (by processing and oxidative coupling reactions) are e.g. known from U.S. Pat. Nos. 5,716,769 and 5,811,229 and EP-A 0 844 520, and JP-A 10-274 824 respectively and causes the same problems as set forth hereinbefore, moreover showing, in the worst cases, staining of the screens with blue dyes diffusing from the material onto the screen and problems related with criticality of generation of imagewise developed blue colored silver and preservation characteristics of the material.

It has however, untill now, been impossible to traverse the normally expected existing relationship between improved covering power and worse image tone.

OBJECTS OF THE INVENTION

It is a first object of the present invention to change the existing relationship between covering power and image tone as set forth hereinbefore, thus providing an increased covering power and an increased image tone independent from grain thickness.

It is a second object of the present invention to avoid negative influences on development kinetics, i.a. developability due e.g. to the presence of chemical compounds inhibiting development to an unacceptable extent when present in the layers of the photographic material.

It is a further object of the present invention to avoid negative influences on preservation characteristics for the material.

It is still a further object of the present invention to prevent loss in sensitometric characteristics, especially speed and gradation.

Further objects will become apparent from the description hereinafter.

SUMMARY OF THE INVENTION

Therefore a black-and-white silver halide photographic film material (especially for use in radiography) has been provided, wherein said material comprises a transparent film support having first and second major surfaces coated with a subbing layer, further coated adjacent thereto on one side (for a single-side coated material) or on both sides (for a duplitized material) of said film support, optionally in contact with a hydrophilic undercoat layer and overcoated with a protective antistress layer, a light-sensitive silver halide emulsion layer having chemically and spectrally sensitized {111} tabular hexagonal grains, accounting for at least 50%, more preferably at least 70% and still more preferably at least 90% of the total projective surface of all grains, with a mean equivalent volume diameter of from 0.3 μm up to 1.0 μm and an average grain thickness of less than 0.30 μm, wherein said film material is coated with a total amount of silver, expressed as an equivalent amount of silver nitrate of less than 7 g/m2, characterized in that said protective antistress layer(s) and/or said hydrophilic undercoat layer comprise(s) a compound according to general formula (I) in an amount of at least 0.5 mmole, more preferably, at least 1 mmole and up to 5 mmole per mole of coated silver halide. Said formula (I) and other formulae related with more specifically preferred compounds have been given hereinafter in the detailed description and in the claims.

DETAILED DESCRIPTION OF THE INVENTION

A silver halide photographic film material (especially for use in radiography) has thus been provided, wherein said material comprises a transparent film support having first and second major surfaces coated on each of the major surfaces of the support, with a light-sensitive emulsion layer having {111} tabular hexagonal silver halide emulsions, wherein said layer is overcoated with a protective antistress layer at one or both sides of the film support, leading to a single-side coated or double-side coated (duplitized) material.

Optionally the light-sensitive layer(s) is (are) in contact with a hydrophilic undercoat layer, e.g. a hydrophilic layer containing antihalation dyes and therefore called a "antihalation undercoat".

It is an essential feature of the present invention to add to that (those) protective antistress layer(s) and/or said optionally present hydrophilic undercoat layer(s), besides the normally added components as illustrated in the Examples hereinafter, a compound according to the general formula (I) in an amount of at least 0.5 mmole per mole of coated silver halide, wherein said formula (I) is represented hereinafter:

(I)

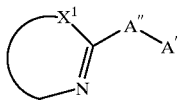

wherein

A" represents a (straight or branched) divalent linking moiety selected from the group consisting of unsubsituted or substituted arylene, heteroarylene, alkylene, alkenylene and alkynylene chain, wherein each of said arylene, heteroarylene, alkylene, alkenylene and alkynylene chain optionally contains heteroatoms, aliphatic or aromatic rings, and alkali soluble groups;

X1 represents atoms necessary to form a five-or six-membered aromatic or heterocyclic ring;

and wherein A' is represented by a functional group.

Typical examples of compounds satisfying the structure as given in the general formula (I) are given hereinafter (formulae (I.1)–(I.4))

(I.1)

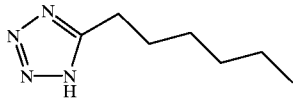

(I.2)

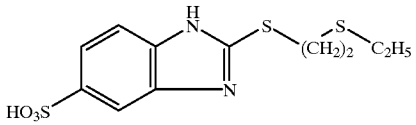

(I.3)

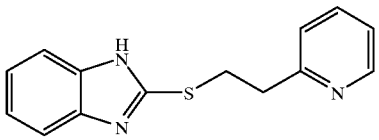

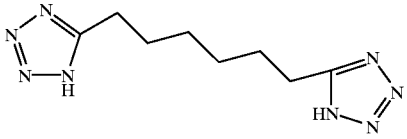

-continued (I.4)

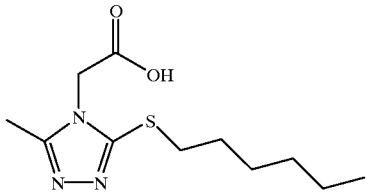

According to the present invention said functional group A' is represented by the formula (II)

(II)

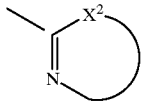

wherein X2 represents atoms necessary to form a five-or six-membered aromatic or heterocyclic ring.

In a further preferred embodiment in the formulae (I) and (II) said five- or six-membered ring is substituted with at least one alkali soluble group. The bifunctional structure of the compound thus obtained has 2 heterocyclic centers interacting with silver, and the said compound does substantially not absorb exposure light as spectrally sensitizing dyes do.

The said bifunctional structure is represented in the formula (I/II) hereinafter:

(I/II)

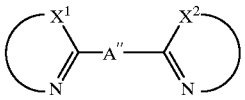

Representative examples of said compounds as becomes clear from the formulae (I) and (II) are e.g. thiazoles, oxazoles, indoles and imidazoles.

Typical examples of bifunctional structures according to the general formula (I/II) are:

(I/II.1)

-continued (I/II.2)

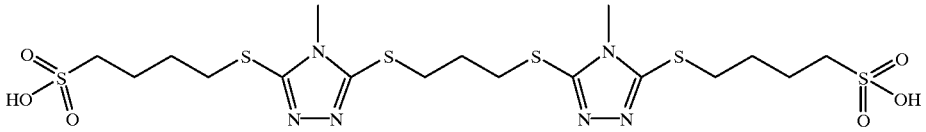

(I/II.3)

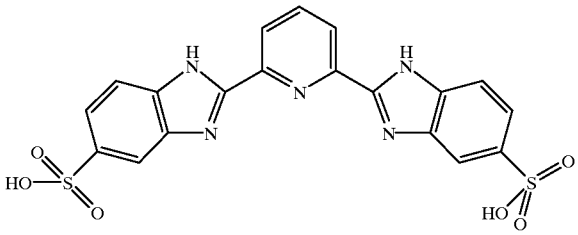

In a preferred embodiment in the compound according to general formulae (I) and (I/II) A" is represented by the formula (III):

$$Y'—Ca-Z—Cb-n-Y'm \quad (III)$$

wherein m equals 0 or 1;

n is equal to 0, or is an integer having a value from 1 to 6;

Y' represents one of S, CR1R2 and NR3, with R1–R3 representing substituted or unsubstituted alkyl, aryl or aralkyl and wherein R1 and R2 may form a substituted or unsubstituted, alicyclic, heterocyclic or aromatic ring;

Z represents O, S, CR7R8, N; or a (straight or branched, unsubstituted or substituted) divalent linking moiety selected from the group consisting of unsubsituted or substituted alkylene, alkenylene and alkynylene chain, wherein each of said alkylene, alkenylene and alkynylene chain optionally contains heteroatoms, aliphatic or aromatic rings, and alkali soluble groups;

Ca and Cb each independently represents a straight or branched aliphatic carbon chain, wherein a and b are equal to 0, or are represented by an integer having a value from 1 to 5.

Typical examples of linking groups have following structures:

(III.1)

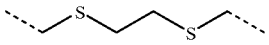

(III.2)

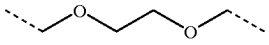

(III.3)

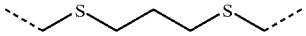

As in a more preferred embodiment in the formula (III) of the compound present in the material according to the present invention each of a and b independently represents an integer having a value of 2 or 3, leading to ethylene and propylene moieties respectively in the divalent linking group.

Examples of compounds having such linking groups according to the formula (III) having no bifunctional structure is given hereinafter (see formula (I.5)) as a particular example of a compound according to the formula (I):

(I.5)

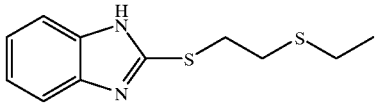

Another particular compound having a bifunctional structure is given hereinafter as formula (I.6) wherein a hydrophilic group is substituted on each imidazole ring, making part of both benzimidazole nuclei, further having an ethylenethio group:

(I.6)

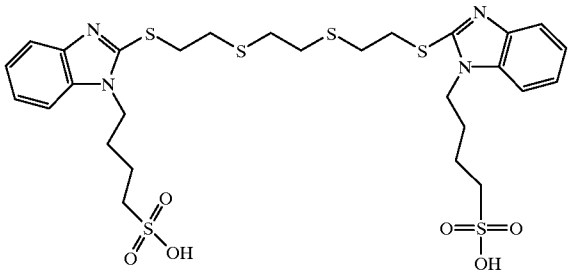

In a more preferred embodiment the linking group A", according to formula (III) is combined with A', according to formula (IV)

(IV)

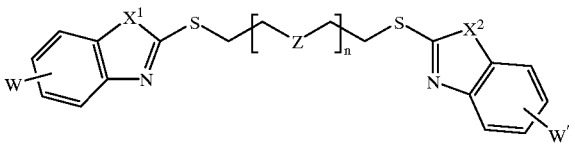

wherein W and W' may be the same or different and stand for hydrogen or a group substituting the aromatic rings. In a preferred embodiment W and W' each represents same or differing groups, being an alkali soluble group or a substituent having an alkali soluble group.

Typical examples of compounds according to the general formula (IV) have been represented by the structures given hereinafter:

(IV.1)

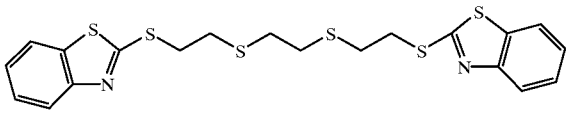

(IV.2)

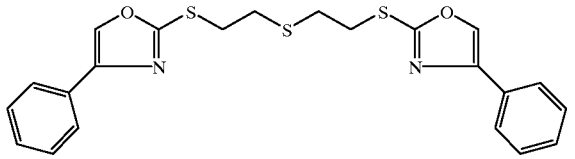

-continued (IV.3)

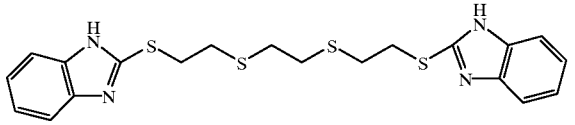

wherein said structures (IV.1), (IV.2) and (IV.3) have ethylene thio moieties and thiazole, oxazole and imidazole moieties respectively.

Even more preferred in the material of the present invention is the presence of a compound according to formula (IV) wherein at least one of W and W', and most preferably each of W and W', if differing from hydrogen, represents an alkali soluble group or a substituent having an alkali soluble group.

When in the compound according to the formula (IV) presented is hereinbefore, W and/or W' have an alkali soluble group, said group is an acidic group selected from carboxylic acid, sulphonic acid and phosphonic acid as becomes clear from formulae (V.1)–(V.4) given hereinafter, without however being limited thereto.

(V.1)

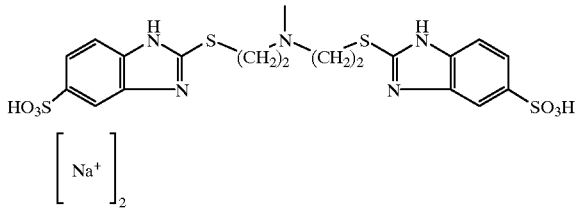

wherein in formula (V.1) an aminoalkylene chain is present;

(V.2)

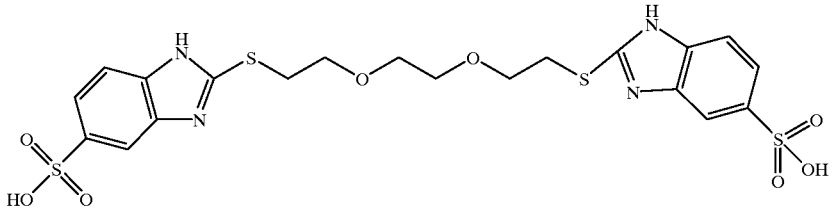

wherein said structure (V.2) has an oxyethylene moiety;

(V.3)

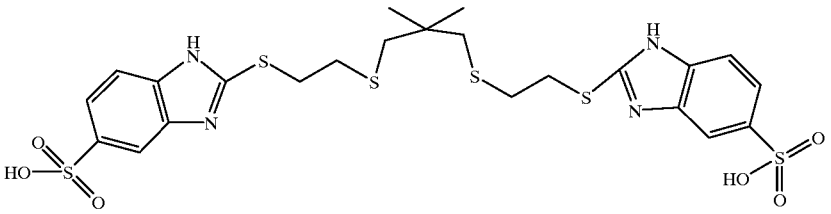

structure (V.3) having a structural chain directing group;

(V.4)

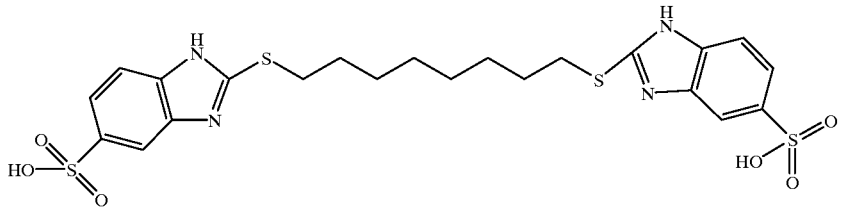

wherein said structure (V.4) has an alkyl chain with end-standing thio moieties.

As in a more preferred embodiment, as already set forth hereinbefore, in the divalent linking group according to the formula (III) each of a and b independently represents an integer having a value of 2 or 3, ethylene groups or propylene groups are present in a polysulfide chain when Z represents S in formula (IV), presence of alkali soluble groups as in the compounds according to the formulae (V.1)–(V.4) leads to a further preferred compounds according to the formulae (VI.1)–(VI.5) as represented hereinafter, again without being limited thereto:

(VI.1)

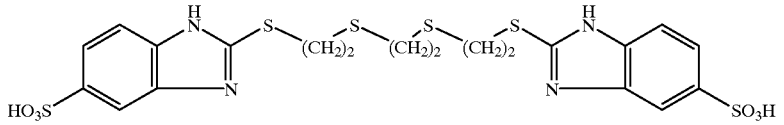

(VI.2)

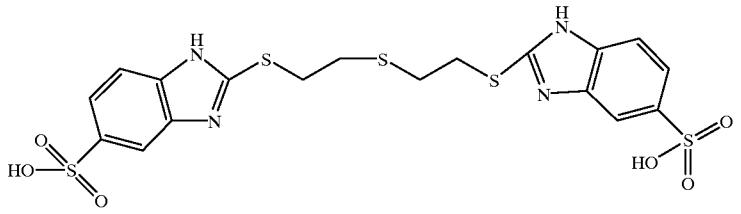

(VI.3)

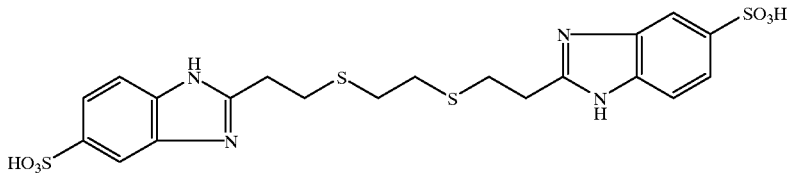

structure (VI.3) representing an alkane benzimidazol;

(VI.4)

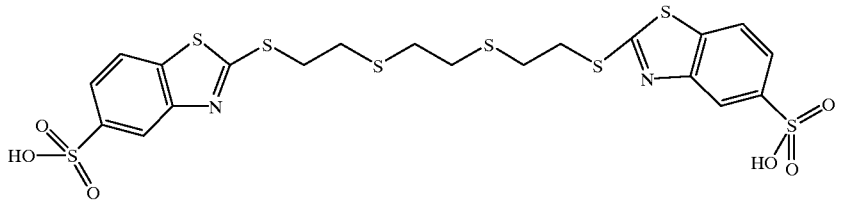

structure (VI.4) representing a thiazole compound;

(VI.5)

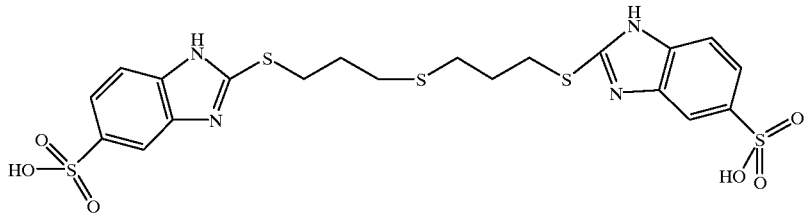

and structure (VI.5) having a propylenethio-moiety.

It has now unexpectedly been observed that, when examining the black-and-white silver image obtained after processing of the exposed material according to the present invention, that the presence of compounds according to the general formula (I) or to the more particular preferred formulae (IV) or (V), when present in at least one non-light-sensitive hydrophilic coating layer as the protective antistress layer(s) and/or the optionally present hydrophilic undercoat layer(s) between subbing layer(s) and light-sensitive layer(s) of the said material, a further improved image tone is observed, in that a "colder" blue-black image is obtained for an equal and even an increased covering power.

According to the present invention the compound(s) according to the formulae set forth hereinbefore are present in an amount of at least 1 mmole up to 5 mmole per mole of coated silver halide.

The protective antistress layers of the silver halide photographic material according to the present invention may be the outermost layers of the material but an outermost after-layer may be optionally present as has been disclosed e.g. in EP-A's 0 644 454 and 0 644 456, wherein a synthetic clay is present in favour of pressure resistance. Protective antistress layers, besides their function as protection layer may include compounds providing better antistatic properties as disclosed e.g. in EP-A 0 644 454 (with polyoxyalkylene compounds as antistatic agents), in EP-A's 0 505 626, 0 534 006 and 0 644 456. As said layers are in most cases outermost layers their contribution to satisfactory surface characteristics of the processed film material is very important, e.g. from the point of view of an excellent surface glare as desired by examining medecins, as has been described in EP-A 0 806 705 an in EP-A 0 992 845.

The film material of the present invention, besides the protective antistress layer(s) and/or undercoat layer(s) containing a polyether moiety as in the general formula (I), thus further comprises a photosensitive layer at one or both sides of the transparent support, said layer containing in an amount of at least 50%, preferably at least 70% and even more preferably at least 90% of the total projective surface of all grains a {111} tabular grain emulsion containing chemically and spectrally sensitized hexagonal grains having a mean equivalent volume diameter of from 0.3 $\mu$m up to 1.0 $\mu$m and an average grain thickness of less than 0.30 $\mu$m, preferably from 0.05 $\mu$m up to 0.25 $\mu$m and wherein said film material is coated with a total amount of silver, expressed as an equivalent amount of silver nitrate of less than 7 g/m2, more preferably from 3.0 up to at most 6.0.

Average grain volumes can be determined from calculations, after measurement for each individual grain of its volume determined after having applied electrochemical reduction techniques, wherein electrical signals thus obtained are related with silver halide grain volumes after total reduction thereof to metallic silver at the cathode of an electrochemical cell. The percentage of the total projective area of all tabular grains with respect to the total projective area of all grains present in the emulsion is calculated from electron microscopic photographs. Average grain diameters and thicknesses of the tabular grains are calculated after determination of individual grain thickness and diameter, calculated as equivalent circular diameter of the hexagonal surface, from shadowed electron microscopic photographs or scanning electron microscopic photographs. From the average ratios of (equivalent circular) diameter to thickness for each individual tabular grain aspect ratios are determined in order to get ability to further calculate the mean aspect ratio of the tabular grains in the emulsion distribution.

The film material may comprise light-sensitive layers, wherein presence of more than one light-sensitive layer per side is not excluded, at one (single-side coated) or both (double-side coated or duplitized) sides of the film support. According to the present invention, in favour of developability, said {111} tabular hexagonal silver halide grains are preferably silver halide grains, containing silver iodide in limited amounts: the film material should contain chemically and spectrally sensitized {111} tabular hexagonal grains having a composition wherein silver iodide is present in an amount of less than 3.0 mole %; preferably less than 1.0 mole % and even more preferably from 0.1 up to 0.4 mole % of iodide based on silver, without further restrictions with respect to the halide composition of said silver halide grains. Any possible combination of chloride, bromide and iodide (apart for the preferred low iodide amounts as set forth hereinbefore), leading to {111} hexagonal tabular silver halide grains suitable for use in the materials according to the present invention is admissible. Said {111} hexagonal tabular grains preferably have an average aspect ratio of 2 or more, preferably in the range from 5 to 20, with an average grain thickness of less than 0.30 $\mu$m, more preferably from 0.05 up to 0.25 $\mu$m, and account for at least 50%, more preferably at least 70% and still more preferably at least 90% of the total projective area of all grains. In a further preferred embodiment the {111} tabular grain population with hexagonal geometry for the flat tabular grains, make part of a light-sensitive emulsion which is homogeneous, i.e., has a variation coeffient of less and 0.40 and more preferably even from 0.10 up to 0.30, based on the equivalent circular diameters calculated for the individual {111} tabular hexagonal grains.

According to the present invention the chemically and spectrally sensitized {111} tabular hexagonal grains present in at least one light-sensitive layer of the material of the present invention thus have an average grain thickness of from 0.05 up to 0.25 $\mu$m.

Preparation methods for {111} tabular grain emulsions rich in silver bromide which are advantageously used in light-sensitive layers of materials of the present invention can be found in Research Dislosure No. 389057, p. 591–639 (1996), more particularly in Chapter I; No. 375042, published Jul. 1, 1995; No. 391021, published Nov. 1, 1996; No. 394023, published Feb. 1, 1997. A very useful method has been described in EP-A 0 843 208. In a preferred embodiment for use in a radiographic material according to the present invention {111} tabular hexagonal crystals rich in silver bromide are composed of silver bromoiodide or silver bromochloroiodide (with less than 10 mole % of silver chloride, based on silver). Iodide ions may be divided homogeneously or heterogeneously over the grain volume. When divided heterogeneously silver iodide may be present in one or more shells, divided over the grain volume.

In a preferred embodiment however silver iodide is present at the surface of all {111} tabular hexagonal grains. Iodide ions can be provided in the preparation method by addition of such grains by adding an inorganic iodide salt as potassium iodide to the reaction vessel. More preferred as providing slower liberation of iodide in the reaction vessel are organic agents releasing iodide ions in order to provide the low silver iodide concentrations, not being equal or exceeding 3 mole %, more preferably not being equal or exceeding 1 mole % and even more preferably not exceeding the range from 0.1 mole % up to 0.4 mole % based on silver over het whole grain volume. Addition of iodide by organic agents releasing iodide ions can thus be applied within the context of the present invention as has been described e.g. in EP-A's 0 561 415, 0 563 701, 0 563 708 and 0 651 284 and in U.S. Pat. Nos. 5,482,826 and 5,736, 312. In an alternative method iodide ions can be released from iodate as has been described in U.S. Pat. No. 5,736, 312. Release of iodide in the presence of a compound adjusting the rate of iodide release can be applied as described in U.S. Pat. No. 5,807,663. In another embodiment addition of iodide to growing or already grown emulsion grains rich in silver bromide and/or chloride is performed by adding fine preformed grains of silver iodide, whether or not including bromide and/or chloride in minor amounts, said grains having a grain diameter of not more than 100 nm, and more preferably, even not more than 50 nm. Such fine grains are so-called "Lippmann" emulsions. Addition of iodide making use from such fine grains rich in silver iodide can thus be applied as has been described for the preparation of {111} tabular grains in JP-A's 04251241 and 08029904 and in EP-A's 0 662 632 and 0 658 805, wherein an outermost phase rich in silver iodide has been added to {111} tabular grains rich in silver bromide (optionally comprising up to less than 10 mole % of silver chloride). Addition of said fine silver iodide "Lippmann emulsions" to the surface of the silver halide crystals in order to get a global iodide content of less than 3 mole %, preferably less than 1 mole %, and even more preferred from 0.1 mole % up to at most 0.4 mole % based on silver, in the grain may advantageously proceed as disclosed in EP-A 0 475 191, wherein an excellent speed/fog ratio and a high covering power are attained. Not only in favour of image tone as set forth in the objects of the present invention but also in favour of developability it is recommended for said tabular grains, when iodide is present, that all silver iodide is present on the grain surface thereof in an amount in order to get an average amount of iodide over the whole grain volume of less than 1 mole % and most preferably in the range from 0.1 up to 0.4 mole %, based on silver.

Preparation methods for {111} tabular grain emulsions rich in silver chloride which can advantageously be used in the context of the present invention to be coated in the light-sensitive layers of the material as claimed can be found e.g. in EP-A's 0 481 133 and 0 678 772 and in Research Disclosure No. 388046, published Aug. 1, 1996. Preparation of such grains always require use of a crystal habit modifier in favour of stability of the [111 planes as for AgCl [100 planes are much more stable and as [111 planes easily tend to transform into [100 planes when no crystal habit modifying agent (such as adenine or another aminoazaindene compound) is present.

Preparation of {111} tabular grain emulsions is commonly, as is known by anyone skilled in the art, performed in the presence of gelatin. In one embodiment the precipitation of the hexagonal {111} tabular silver halide crystals according to the present invention is performed in the presence of a protective, hydrophilic colloid, e.g. conventional lime-treated or acid treated gelatin but also oxidized gelatin (see e.g. EP-A 0 843 208) but even a synthetic peptizer may be used. The preparation of such modified gelatin types, when use is would be made thereof, can be found in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions for the materials according to the present invention are precipitated in the absence of gelatin by using colloidal silica sol as a protective colloid in the presence of an onium compound, preferably a phosphonium compound, as has been described in EP-A 677 773. Colloidal silica sol as a binder providing colloidal stability during all preparation steps can indeed be applied as a valuable alternative.

In order to control the grain size, beside dyes (even spectral sensitizing dyes e.g.) or crystal habit modifiers, other grain growth restrainers or accelerators may also be used during the precipitation, together with flow rate variations and/or concentration variations of the silver and halide salt solutions, the temperature, pAg, physical ripening time, etc . . . Silver halide solvents such as ammonia, a thioether compound, thiazolidine-2-thione, tetra-substituted thiourea, potassium or ammonium rhodanide and an amine compound may be present during grain precipitation in order to further adjust the average grain size.

At the end of the precipitation the emulsion can be made free from excess of soluble inorganic salts by a conventional washing technique e.g. flocculation by ammonium sulphate or polystyrene sulphonate, followed by one or more washing and redispersion steps. Another well-known washing technique is diafiltration or ultrafiltration. Finally extra gelatin is added to the emulsion in order to obtain a gelatin to silver ratio which is optimized with respect to the coating conditions and/or in order to establish the required thickness of the coated emulsion layer. Preferably a gelatin to silver halide weight ratio ranging from 0.3 to 1.0, and more preferably around 0.5, may be envisaged in order to provide low amounts of gelatin to be coated in favour of e.g. rapid processing applicability for the coated materials.

It is clear that {111} tabular silver halide emulsion grains, present in light-sensitive emulsion layers of materials according to the present invention, should, besides being spectrally sensitized, also be chemically sensitized. Said chemical sensitization, preferably following spectral sensitization, preferably proceeds at least with a combination of labile sulphur compounds and gold compounds and more preferably with compounds providing sulphur, selenium or even tellurium and gold in favour of attainable sensitivity, also called speed. Chemical sensitization methods for {111} tabular grain emulsions which can be applied herein can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134. Useful labile selenium compounds suitable for use in the present invention have been disclosed in EP-A's 0 831 363, 0 889 354 and 0 895 121. Said labile selenium compounds are commonly applied in combination with sulphur and gold, and so are labile tellurium compounds as has been disclosed in EP-Application No. 99202439, filed Jul. 23, 1999.

The {111} tabular hexagonal silver halide emulsion grains present in light-sensitive emulsion layers of materials according to the present invention, are spectrally sensitized in the blue to near ultraviolet wavelength range and/or green wavelength range, depending on the requirements as set forth by medecins examining radiological images as especially sharpness (low cross-over percentage), but also contrast (which should be a "dedicated contrast" depending on the density range wherein image details should be discernable), speed and density range.

Preparation of spectrally and chemically sensitized tabular grains as applied to emulsion grains to be coated in light-sensitive layers of a radiographic material according to the present invention has been described in U.S. Pat. No. 4,439,520, wherein it has been established to perform spectral sensitization before chemical sensitization, so that the spectral sensitizer acts as a site-director for the sensitivity specks, generated during chemical sensitization. A broad review about spectral sensitization can be found in in Research Dislosure No. 389057, p. 591–639 (1996), more particularly in Chapter V. Further useful information about additives which may be used in order to prepare emulsions to be coated in a material according to the present invention can be found in Research Dislosure No. 389057, p. 591–639 (1996), as in Chapter VII about antifoggants and stabilizers, in Chapter VIII about coating physical property modifying addenda, in Chapter XI about layer arrangements and in Chapter XV about supports.

According to the present invention a light-sensitive silver halide photographic film material is provided, wherein said emulsion layer comprises an azacyanine dye as a site directing compound. More preferably said azacyanine dye satisfies general formulae (VII.1) or (VII.2) and is preferably present in said layer besides one or more J-aggregating spectrally sensitizing dye(s), wherein a molar ratio amount between said site directing compound and said a J-aggregating spectrally sensitizing dye(s) is preferably at least 1:6 for a grain coverage of said {111} tabular grains exceeding 50% and wherein general formulae (VII.1) or (VII.2) are represented as (VII.1)

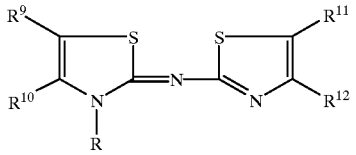

and

-continued (VII.2)

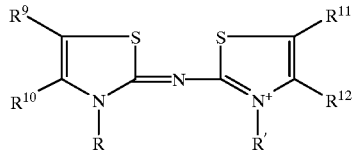

wherein each of the substituents $R_9$–R12 independently represents hydrogen, an (unsubstituted or substituted) alkyl, an (unsubstituted or substituted) aryl or an (unsubstituted or substituted) aralkyl;

wherein R9 and R10 and/or R11 and R12 may form a (substituted or unsubstituted) benzene ring, which, if substituted, has the same or different substituents as R9–R12;

wherein R represents an (unsubstituted or substituted) alkyl, an (unsubstituted or substituted) aryl or an (unsubstituted or substituted) aralkyl group;

wherein R' represents hydrogen, an (unsubstituted or substituted) alkyl, an (unsubstituted or substituted) aryl or an (unsubstituted or substituted) aralkyl group;

and wherein cations or anions are present as charge compensating ions.

According to the present invention the material thus has {111} tabular grains which have been made sensitive to the ultraviolet/blue and/or green range of the wavelength spectrum.

In one embodiment according to the present invention the film material comprises in its light-sensitive emulsion layer (s) coated on one or both sides of the subbed transparent support an emulsion having {111} hexagonal tabular grains, spectrally sensitive to irradiation in the wavelength range shorter than 420 nm by the presence of at least one blue spectral sensitizer and of at least one dye selected from the group consisting of monomethine cyanine dyes and azacyanine dyes. A blue/ultraviolet absorbing dye combination of zeromethine dyes with monomethine or azacyanine sensitizing dyes absorbing blue/UV-radiation as described in EP-A 1 045 282 is particularly suitable for use when the radiographic material according to the present invention is applied in combination with one or two blue/UV-intensifying screens. Besides the favourable diagnostic value with respect to image quality thanks to a low fog level, a high overall contrast, an enhanced sharpness (low cross-over percentage) and absence of residual color, even in rapid processing cycles, as described therein, a particularly good image tone is provided offering cold black-bluish images as desired by the examiners, according to the objects of the present invention.

In the film material according to the present invention said film thus in one embodiment comprises as spectrally sensitizing dye for the {111} hexagonal tabular silver bromoiodide or silver bromo(chloro)iodide grains, in order to make them spectrally sensitive to irradiation in the said wavelength range shorter than 420 nm, at least one zeromethine dye according to the general formula as set forth in EP-A 0 712 034 and at least one dye selected from the group consisting of monomethine cyanine dyes (VIII) and azacyanine dyes (VII). An especially preferred blue-sensitizing zeromethine dye for spectrally sensitizing {111} tabular grains is given hereinafter in formula (IX.1)

(IX.1)

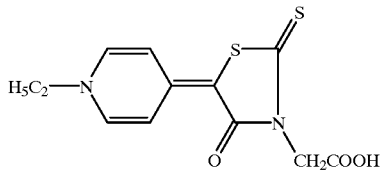

5-(1-ethyl-4(1H)-pyridylene)-4-oxo-2-thioxo-3-thiazolidine acetic acid

Another useful zeromethine dye is represented by its structure (IX.2).

(IX.2)

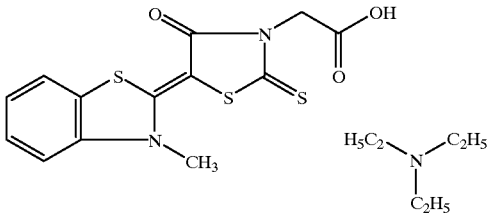

5-(3-methyl-3(3H)-benzothiazolylidene)-4-oxo-2-thioxo-3-thiazolidine acetic acid The zeromethine J-aggregating blue-sensitizing dye or dyes (as the representative dyes according to the formulae (IX.1) and (IX.2), without being limited thereto) may be present alone, but are thus preferably present besides at least one dye selected from the group consisting of azacyanine dyes (the formulae of which are given hereinafter under the formulae (VII)) and monomethine cyanine dyes further given hereinafter (see formulae (VIII)) in order to reach is the objects of the present invention, thereby reducing dye stain after processing and improving speed. Moreover an exceptionally suitable image tone is provided if applied as spectrally sensitizing combination to the {111} hexagonal tabular silver bromoiodide grains having all silver iodide at their grain surface in the claimed amounts of less than 1 mole %, based on silver over the whole grain volume.

Particularly preferred monomethine cyanine dyes suitable for use in emulsions coated in light-sensitive layers of the material used in film/screen systems related with the present invention correspond to the formula (VIII.1) or (VIII.2), represented hereinafter, without however being limited thereto:

(VIII.1)

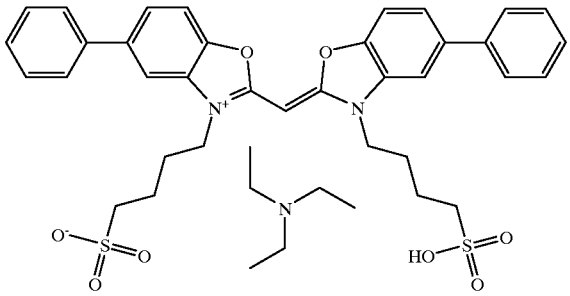

-continued (VIII.2)

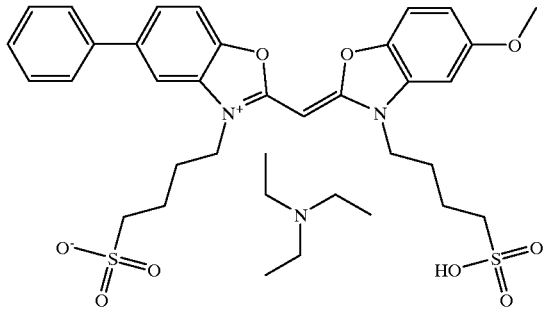

Said blue-sensitizing dye or dyes are added as first dye during the chemical ripening procedure, before addition of the chemical ripening compounds or agents. Mixtures of blue sensitizing J-aggregating zeromethine dyes as those according to formula (IX.1) and (IX.2) are particularly interesting from the point of view of an increased spectral response in form of speed, which can be achieved at lower total amounts of dyes as becomes clear from U.S. Pat. No. 5,707,794.

In another embodiment the material according to the present invention has grains which have been made sensitive to the green range of the wavelength spectrum. The film material as claimed thus has at least one emulsion comprising hexagonal {111} tabular silver halide grains, spectrally sensitive to irradiation in the wavelength range between 500 and 555 nm by the presence of at least one spectrally sensitizing trimethine dye according to the formulae as described e.g. in EP-A 0 678 772 and of at least one dye selected from the group consisting of azacyanine dyes and monomethine cyanine dyes according to the formulae (VII) and (VIII) respectively. The film then provides perfect matching with the screen emitting said radiation in the green wavelength range with a maximum around 540–545 nm as in a preferred embodiment absorption of radiation in the preferred green wavelength range by the {111} tabular silver halide grains is corresponding with at least 50% and more preferably at least 80% of the total radiation absorption by the said grains. Therefore in a preferred embodiment radiation-sensitive emulsions having {111} tabular hexagonal silver halide grains, as used in light-sensitive layers of materials according to the present invention, are made sensitive to irradiation in the wavelength range between 530 and 555 nm by the presence of a J-aggregating spectrally sensitizing cyanine dye. Preferred (orthochromatic) spectrally sensitizing dyes are J-aggregating dyes as described in EP-A 0 678 772 and 0 953 867, wherein e.g. trimethine benzoxazoles and imidazoles are used apart or in combination. In a particularly preferred embodiment said J-aggregating spectrally sensitizing dye is a 5,5'-dichloro-3,3'-bis(SO3-R)-9-ethyl-benzoxa-carbocyanine with R being n-propylene or n-butylene and more particularly anhydro-5,5'-dichloro-3,3'-bis(n-sulphobutyl)-9-ethyl-oxacarbocyanine hydroxide or anhydro-5,5'-dichloro-3,3'-bis(n-sulpho-propyl)-9-ethyloxa-carbocyanine hydroxide. Furthermore green-light absorbing spectral sensitizers according to the formulae given in JP-A's 06-035104; 06-035101; 06-035102; 62-191847; 63-249839; 01-312536; 03-200246; U.S. Pat. No. 4,777,125 and DE 3,819,241 may be used. The right choice of said sensitizers or combinations thereof is always related with the purpose of obtaining the highest possible photographic speed while reducing dye stain, even after rapid processing.

As it is a particularly favourable aspect for materials coated from emulsions having tabular grains in general, and more specifically for materials according to the present invention coated from emulsions having hexagonal {111} tabular grains to be coated with lower amounts of silver without loss of covering power in the material, the total amount of coated silver halide in said film material, expressed as an equivalent amount of silver nitrate, is less than 7 g/m2, preferably in the range from 3.0 up to 6.0 g.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as the backing layer(s) of single-side coated materials, or to a hydrophilic undercoat layer between light-sensitive emulsion layer and subbed support. The presence of such dye(s) in adapted amounts is not only recommended in order to adjust the sensitivity of the different emulsion layers and eventually the required contrast, but also in order to reduce scattering of exposure radiation and thus to enhance sharpness. Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersions of water insoluble dyes having a mean particle diameter of less than 10 $\mu$m, more preferably less than 1 $\mu$m and still more preferably less than 0.1 $\mu$m. Examples of such dyes are disclosed in EP-A's 0 384 633; 0 351 593; 0 586 748; 0 587 230 and 0 656 401, EP-A's 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in form of a solid silica particle dispersion as disclosed in EP-A 0 569 074. Still another technique applied in order to obtain ultra fine dye dispersions consists in acidifying a slightly alkaline coating composition "in situ" just before coating it onto the supporting layer. A more recent review of dispersion methods, useful in the context of the present application has been described in EP-A 0 756 201.

Not only film materials may contain such dyes in favour of image definition, but also presence thereof in screens may be advantageous as has been described in U.S. Pat. No. 5,381,015.

The silver halide emulsions used in light-sensitive layers of the material according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide.

Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used therefore, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. Nos. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids,—unsaturated dicarboxylic acids, hydroxyalkyl (meth)acrylates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 $\mu$m. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material according to the present invention may comprise an antistatic layer in order to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides (see e.g. EP-A 0 890 874) or a polymer latex and the like or polymers providing permanent antistatic properties as polyethylene dioxythiophene described e.g. in U.S. Pat. Nos. 5,312,681; 5,354,613 and 5,391,472; and in EP-A 1 031 875.

Single-side coated or duplitized film materials of the present invention for use in radiographic applications are irradiated by the light emitted imagewise by one or more X-ray intensifying screen(s) after conversion of X-ray irradiation to the said light by luminescent phosphors coated in the said screen(s) or panel(s), in intimate contact therewith at one or both sides of the coated film support during X-ray exposure of part of a patient. A diagnostic silver image, in conformity with the X-ray image, is obtained after processing of the said film material. During X-ray irradiation said film is arranged in a cassette in contact with the light-sensitive side in contact with one screen or between two X-ray intensifying screens, thus forming a film/screen system.

According to the present invention the radiographic screen/film system thus obtained, comprises a single-side coated or a duplitized film as claimed, in contact with one screen or sandwiched between a pair of supported or self-supporting X-ray intensifying screens, wherein said one screen or said pair of supported or self-supporting X-ray intensifying screens comprise(s) luminescent phosphor particles emitting at least 50% of their emitted radiation in the wavelength range for which said material has been made spectrally sensitive.

In one embodiment according to the present invention a radiographic screen/film combination or system is provided comprising a single-side coated film material in contact with one screen or duplitized film material, sandwiched between a pair of supported or self-supporting X-ray intensifying screens, characterized in that i) said supported or self-supporting X-ray intensifying screen(s) essentially consist(s) of luminescent phosphor particles emitting at least 50%, and more preferably at least 80%, of their emitted radiation in the wavelength range shorter than 420 nm, as e.g. a niobium and gadolinium doped, monoclinic M, yttriumtantalate (MYT) phosphor or a calcium tungstate phosphor;

ii) said film comprises {111} tabular silver halide grains, spectrally sensitive to irradiation in the said wavelength range shorter than 420 nm by the presence of at least one J-aggregating blue spectral sensitizer according to the formula (IX) and of at least one the non-J-aggregate-forming dyes selected from the group consisting of azacyanine dyes and monomethine cyanine dyes according to the formulae (VII) and (VIII) respectively, given hereinbefore in the description, wherein said emulsion is present in at least one light-sensitive emulsion layer on one side or on both sides of the film support.

Luminescent phosphors suitable for use in a conventional intensifying screen of a radiographic film/screen system as the one according to the present invention must have a high prompt emission of fluorescent light on X-ray irradiation and low afterglow in favour of image sharpness. The relationship between resolution and speed of X-ray intensifying screens is described e.g. in Med. Phys. 5(3), 205 (1978).

Specific intensifying screens emitting ultraviolet-blue radiation which may be used in screen/film systems of the present invention have e.g. been disclosed in U.S. Pat. Nos. 4,225,653; 4,387,141; 4,710,637; 5,112,700; 5,173,611 and 5,432,351; in EP-A's 0 650 089; 0 658 613; in PCT-Applications WO 93/11457 and WO 95/15514. Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and co-doped with samarium as in U.S. Pat. Nos. 5,422,220 and 5,547,807 and even mixtures of tantalates and fluorohalides as in U.S. Pat. No. 5,077,145 and EP-A 0 533 234, replacing CaWO4 as representative for an older well-known generation of luminescent phosphors. Very useful phosphor particles have e.g.been disclosed in EP-A 0 820 069 wherein particles of niobium doped, monoclinic M, yttriumtantalate phosphor and particles of an europium doped bariumfluorohalide phosphor are composing the screen. In this film/screen system according to the present invention preferred phosphor particles are niobium and gadolinium doped, monoclinic M, yttriumtantalate (MYT) phosphor corresponding to formula (X):

$$YTaO4:Gd:Nb \quad (X)$$

In another embodiment the film material has {111} tabular silver bromo(chloro)iodide emulsions spectrally sensitized with spectrally sensitizing dyes absorbing light in the green wavelength range as has been set forth hereinbefore.

Accordingly in another embodiment according to the present invention a radiographic screen/film combination or system is thus provided comprising a single-side coated film material in contact with one screen or a duplitized film material, sandwiched between a pair of supported or self-supporting X-ray intensifying screens, characterized in that i) said X-ray intensifying screen(s) essentially consist(s) of luminescent phosphor particles emitting at least 50% and more preferably at least 80% of their emitted radiation in the green wavelength range from 500 nm to 550 nm, as e.g. a terbium doped gadolinium oxisulfide phosphor;

ii) said film comprises {111} tabular silver halide grains, spectrally sensitive to irradiation in the said wavelength range from 500 to 550 nm by the presence of at least one J-aggregating green spectral sensitizer and of at least one the non-J-agregating dyes selected from the group consisting of azacyanine dyes and monomethine cyanine dyes, as respectively given hereinbefore in the formulae (VII) and (VIII), wherein said emulsion is present in at least one light-sensitive emulsion layer on one side or on both sides of the film support. In this film/screen system according to the present invention preferred phosphor particles are gadolinium oxysulfide phosphor particles corresponding to formula (XI):

$$Gd2O2S:Tb \quad (XI)$$

Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398 and is suitable for use in the context of the film/screen system according to the present invention.

Specific intensifying screens or conversion screens emitting green or blue/ultraviolet radiation for use in the diagnostic image forming method according to the present invention are the commercially available X-ray generating devices providing an exposure to X-rays (e.g. with a tube voltage from 70 kV up to 100 kV as in chest radiography when duplitized film materials of the present invention are used or from 20 kV up to 40 kV as in mammography when single-side coated film materials of the present invention are used, wherefore the relationship between resolution and speed of X-ray intensifying screens has been described e.g. in Med. Phys. 5(3), 205 (1978)). The thickness of the phosphor layer therein depends on the amount of coated phosphor required in order to obtain the desired screen speed. X-ray intensifying screens used in the film/screen system according to the present invention can be self-supporting or supported. X-ray intensifying screens in the screen/film system according to the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto. X-ray intensifying screens according the present invention can be self-supporting or supported. X-ray intensifying screens in accordance with the present invention generally comprise in order: a support (also called substrate), at least one layer comprising phosphor particles is dispersed in a suitable binder and a protective coating coated over the phosphor containing layer to protect said layer during use. Further, a primer layer is sometimes provided between the phosphor containing layer and the substrate to closely bond said layer thereto. A plastic film is preferably employed as the support material. Depending on the speed class of the screens for which a synergistic effect should be attained in the relation between speed and sharpness, supports characterized by their reflectance properties, expressed as % reflectance over the wavelength range from 350 to 600 nm, are particularly used as described e.g. in U.S. Pat. No. 5,381,015. Such supports can be highly light reflecting as e.g. polyethylene terephthalate comprising a white pigment, e.g. BaSO4, TiO2, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens in the film/screen system according to the present invention. In most applications the phosphor layers contain sufficient binder to give structural coherence to the layer. A mixture of two or more of these binders may be used, e.g., a mixture of polyethyl acrylate and cellulose acetobutyrate. The weight ratio of phosphor to binder is generally within the range of from 50:50 to 89:11, preferably from 80:20 to 89:11. The screen used in a screen/film system according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer.

After the formation of the fluorescent layer, a protective layer is generally provided on top of the fluorescent layer. In a preferred embodiment the protective coating has a layer thickness d comprised between 1 and 50 μm and an embossed surface roughness is applied for high ease of manipulation, thereby avoiding sticking, friction and electrostatic attraction with maintenance of an excellent image resolution. The embossed protective layer can be provided on the phosphor layer in order to protect it against mechanical and chemical damage as described in EP-A's 0 510 753 and 0 510 754. Assemblies providing means for reducing cross-over to less than 10% for radiation longer than 300 nm in wavelength have been described e.g. in U.S. Pat. No. 5,259,016.

It is not excluded to use screen/film combinations wherein duplitized materials of the present invention have green sensitized emulsion layers on one side and blue/UV sensitized layers on the other side, wherein before X-ray exposure contact is made with a green emitting and a blue/UV-emitting screen for the respective sides of the duplitized material. Even film materials having e.g. two light-sensitive layers at one or both sides, wherein one layer is made sensitive to the blue-UV wavelength range,whereas the other layer is made sensitive to the green wavelength range may be provided and in the corresponding film/screen combination a screen having a mixture of green- and blue/UV-emitting phosphors may be provided. In order to attain desired properties with respect to sensitometry (desired sensitometric curve from the point of diagnostic view) and/or image quality (granularity and/or image definition, particularly sharpness) such miscellaneous film/screen arrangements may be desired.

According to the present invention a method of image formation of a black-and-white image is further provided by consecutively performing the steps of exposing to X-rays the screen/film combination or system described hereinbefore; followed by processing the film according to the present invention by the steps of developing, fixing, rinsing and drying.

The said processsing is preferably performed in an automatic processsing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent; fixing said material in a fixer, optionally without hardening agent; rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may als be present. As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342. Especially preferred developers comprising ecologically acceptable developing agents such as ascorbic acid and derivatives thereof have been described in EP-A 0 732 619 and in U.S. Pat. Nos. 5,593,817 and 5,604,082. Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented. In order to reduce "sludge formation" which is favored by solubilizing agents like sulphites, present in the developer as preservatives, a particularly suitable developer solution is the one comprising a reduced amount of sulphite and ascorbic acid which acts as a main developer and anti-oxidant as well and which is called "low-sludge" developer. Suitable measures taken therefore have recently been described in the EP-Applications Nos. 99201891 and 99201892, both filed simultaneously Jun. 14, 1999.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers.

Measures in order to reduce "sludge-formation" have further been described in U.S. Pat. Nos. 5,447,817; 5,462,831 and 5,518,868.

A particularly suitable fixer solution comprises an amount of less than 25 g of potassium sulphite per liter without the presence of acetic acid wherein said fixer has a pH value of at least 4.5, in order to make the fixer solution quasi odorless. If however aluminum ions are present in the fixer composition for whatever a reason, the presence of -ketocarboxylic acid compounds is recommended as has been described in EP-A's 0 620 483 and 0 726 491 as well as in RD 16768, published March 1978. It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated with reduced amounts of silver halide as in the present invention.

Other single-side coated materials wherein the emulsions set forth hereinbefore can advantageously be applied, e.g. with respect to preservation properties, developability, etc. are black-and-white silver halide material used e.g. in micrography, in aviation photography, in black-and-white cinefilms, in laserfilms or hardcopy films and in graphic or reprographic applications. Even use thereof in color photographic applications in favour of preservation of color images is possible, e.g. where black-and-white images of the selected blue, green and red images, each of them being generated apart from an original color print film after having been printed from digitized images (e.g. by laser exposure) on black-and-white microfilms providing high resolution.

Having described in detail preferred embodiments of the present invention it is understood by a person skilled in the art that, within the scope of the present invention, it is not limited thereto, just as the following examples illustrating the present invention.

EXAMPLES

While the present invention will hereinafter be described in connection with preferred embodiments thereof, it will be understood that it is not intended to limit the invention to those embodiments.

Example 1

Preparation of Tabular Emulsion A

To a solution of 6.0 g of inert gelatin in 1.2 1 of demineralized water at 51° C., whereto 15.5 ml of a solution of potassium bromide 2.94 N were added, stirred up to a rate of 400 r.p.m., were added by a double jet method aqueous solutions of 2.40 M AgNO3 (hereinafter referred to as Al) and 2.40 M KBr (hereinafter referred to as B1): at a constant rate of 34.8 ml/min. for Al and 34.8 ml/min. for B1, both solutions were added in a time interval of 28 seconds. During this period, the reaction mixture was maintained at 51° C. The temperature was increased up to 65° C. over a period of 12 minutes 27 seconds: UAg should be in the range from −18±3 mV versus a Ag/AgCl(sat.) reference electrode at a temperature of 65° C.±0.2° C. Immediately thereafter the solution Al was added during 26 seconds at a rate of 3.75 ml per minute and UAg was controlled again and should be in the range of −10±3 mV at a temperature of 65° C.

9 g of inert gelatin in 50 ml of demineralized water of 70° C. was further added. 133 seconds later ultrafiltration was started at a level of 1390 ml, maintaining an ultrafiltration rate of 2.78 l per minute. 8 minutes later stirring velocity was started to increase from 400 to 550 r.p.m. (over the total precipitation time of about 130 minutes) and temperature in the reaction vessel was increased up to 70° C. over 7 minutes. A1 was further added at a rate of 2.6 ml/min over the next 210 seconds. UAg was controlled again and should be in the range of 16±5 mV at a temperature of 70° C.

1 minute later A1 and B1 were run further during 140 seconds at a rate of 5.2 ml/min by double-jet. After 15 minutes 10.18 ml of a 2.94 M solution of potassium iodide was added to the solution B2 having a volume of 805 ml and 2.40 M of potassium bromide.

35 minutes later a double-jet precipitation of A1 and B2 was run during 4 minutes at a rate of 9.9 ml/min. for A1 and at a rate for B1 in order to maintain a constant UAg value of 18 mV, before linearly increasing the rate up to 15.4 ml/min. over the next 63 min. and 10 seconds, further maintaining UAg at a constant value of 18 mV. The reaction vessel was cooled from 70° C. up to 45° C., the stirring rate was decreased from 550 to 250 r.p.m. and ultrafiltration was stopped. At a stirring velocity of 200 r.p.m. diafiltration was performed up to a level of 1250 ml (UAg was measured to have an end value of +80 mV; pressure was 1.8 bar). A further concentration up to 800 ml was performed at the same pressure.

At a temperature of 45° C. peptisation was started for 1 hour after addition of demineralized water up to a volume of 1586 ml and of 205 g of inert gelatin.

Chemical sensitization was performed at 50° C. for about 5 hours after adjustment of the pH in the reaction vessel to a value of 5.5±0.1.

Following ripening agents were added consecutively: 7.5 mg of sodium thiosulphate dissolved in 10 ml of demineralized water at 35° C.; after 4 min.: 50 mg of the azacyanine dye corresponding with the formula hereinafter dissolved in 18 ml of methanol;

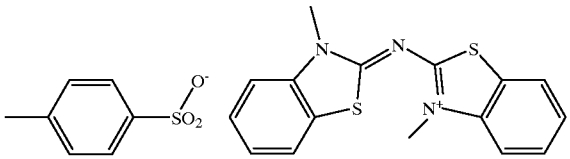

1 min. later 4 ml of a 10 wt. % KSCN solution; 10 minutes later: 0.2 ml of a 4.76×10−3 M solution of sodium toluenethiosulphonate in methanol, further followed by addition after 5 minutes of 780 ml of a 0.25 wt. % solution of anhydro-5,5'-dichloro-3,3'-bis(n-propyl-3-sulphonate)-9-ethyl-benzoxa-carbocyanine triethylammonium salt; after a further waiting time of 30 minutes: 4.5 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole. This mixture was thus chemically ripened during about 5 hours at 50° C. in order to get the best compromise between fog and sensitivity. After cooling phenol was added as a preservative.

A chemically ripened green-sensitized silver bromoiodide emulsion (99 mole % AgBr, 1 mole % AgI) was thus obtained having 160 g AgNO3 and 70.57 g gelatin per kg having {111} tabular grains with an average equivalent volume diameter of 0.57 μm and an average grain thickness of 0.22 μm.

Preparation of Tabular Emulsion B

To a solution of 6.0 g of inert gelatin in 2.127 l of demineralized water at 51° C., whereto 36 ml of a solution of potassium bromide 2.94 N was added, stirred up to a rate of 150 r.p.m., were added by a double jet method aqueous solutions of 1.96 M AgNO3 (hereinafter referred to as Al) and 1.96 M KBr (hereinafter referred to as B1): at a constant rate of 28.0 ml/min. for A1 and 28.0 ml/min. for B1, both solutions were added in a time interval of 35 seconds. During this period, the reaction mixture was maintained at 55° C. When the addition was completed, the temperature of the reaction vessel was increased up to 70° C. in a time interval of 20 minutes. UAg was measured (normal value −25 mV±5 mV vs. a Ag/AgCl(sat.) reference electrode) Immediately thereafter a solution of 475 ml containing 10 wt % of inert gelatin (70° C.) was added. 1 minute later A1 and B1 were added by double-jet precipitation at a rate of 7.5 ml/min and 7.9 ml/min. respectively over the next 60 seconds, before linearly increasing said rates of addition up to 14.4 and 15.2 ml/min. respectively in order to maintain a constant UAg value of −15±2 mV at a temperature of 70° C. 5 minutes later A1 was run further during 10 minute at a rate of 7.5 ml/min by single-jet in order to increase UAg to a value of 100 mV at a temperature of 70° C. Immediately a double-jet addition continued for 1 minute, during which A1 and B1 were run simultaneously at a rate of 7.5 ml/min., before starting increasing the rate linearly during a time of 59 min. 30 seconds from 7.5 up to 22.5 ml/min. The reaction vessel was cooled from 70° C. up to 45° C., the stirring rate was decreased from 400 to 250 r.p.m.. Sulphuric acid was added in an amount to make decrease pH to a value of 3.40–3.50. Polystyrene sulphonic acid was added (3 ml 10 wt %) in order to make flocculate the emulsion and after washing, gelatin and water were added in order to obtain a silver halide content of 246 g/kg, expressed as AgNO3, and a gelatin content of 74 g/kg.

At a temperature of 45° C. peptisation was started for 1 hour after addition of demineralized water up to a volume of 1586 ml and of 205 g of inert gelatin.

Chemical sensitization was performed at 48° C. for about 4 hours after pH adjustment in the reaction vessel to a value of 5.5±0.1.

Following ripening agents were added consecutively: 4 ml of a 10 wt. % KSCN solution was added and after 10 minutes 0.2 ml of a 4.76×10−3 M solution of sodium toluenethiosulphonate in methanol, further followed by 780 ml of a 0.25 wt. % solution of anhydro-5,5'-dichloro-3,3'-bis(n-propyl-3-sulphonate)-9-ethyl-benzoxa-carbocyanine triethylammonium salt; after a further waiting time of 30 minutes: 5 mg of sodium thiosulphate dissolved in 10 ml of demineralized water at 35° C.; 3 min. later: addition of 3.5 ml of a solution containing 1.456×10−3 M chloro auric acid and 1.58×10−2 M ammonium rhodanide, and finally 10 ml of a 1 wt. % solution of 1-(p-carboxy-phenyl)-5-mercapto-tetrazole. This mixture was thus chemically ripened during about 4 hours at 48° C. in order to get the best compromise between fog and sensitivity. After cooling phenol was added as a preservative.

A chemically ripened green-sensitized silver bromoiodide emulsion (99 mole % AgBr, 1 mole % AgI) was thus obtained having 169.4 g of AgNO3 and 74.9 g of gelatin per kg having {111} tabular grains with an average equivalent volume diameter of 0.76 $\mu$m and an average grain thickness of 0.22 $\mu$m.

Coating of the Materials

Preparation of the Film Material.

In order to prepare the coating composition of the light-sensitive silver halide emulsion layer, a mixture of emulsions A and B was made, wherein relative amounts, expressed as equivalent amounts of silver nitrate were combined in a ratio amount of 1:1, and wherein an average total amount of 6.2 g of silver nitrate per m2 were coated. As stabilizers in the emulsion layer coatings 0.1 mmole of 1-(m-carboxymethylthioacetamido)-phenyl-5-mercaptotetrazole and 0.6 mmole of 5-methyl-1,2,4-triazolo-(1,5-A)-pyrimidine-7-ol were added per mole of silver. Resorcinol was further added as hardener stabilizer in an amount of 2.8 g per mole of Ag. Consecutively 0.5 g of polyglycol (MW=6000) was added as a development accelerator; 20 ml of polyoxyethylene surfactant H17C8-Phenyl-(O—CH2-CH2)8-O—CH2—COOH and in an amount of 140 mg (per mole of Ag) fluoroglucinol was added as a hardener accelerator together with polymethyl acrylate latex (in an amount of 140% by weight, based on the amount of gelatin binder) which was used as a plasticizer.

The thus prepared emulsion coating solutions were coated on a blue colored polyethylene terephthalate support (density of the support measured to be 0.200).

The following protective layer was coated thereupon (pH value: 6.25) at both sides:

| Composition of the protective antistress layer | |
|---|---|
| Gelatin | 1.11 g/m$^2$ |
| Graft copolymer (1) | 14 mg/m$^2$ |
| Chromim acetic acid | 7.3 mg/m$^2$ |
| Compound (2) | 16 mg/m$^2$ |
| Compound (3) | 6.7 mg/m$^2$ |
| Mobilcer Q (MMM trademarked product) | 9 ml/m$^2$ |
| Compound (4) | 15 mg/m$^2$ |
| Compound (5) | 40 mg/m$^2$ |

-continued

Composition of the protective antistress layer

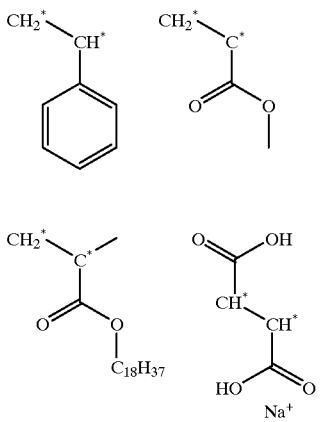

Compound (1)

$NH_3$

Compound (2)

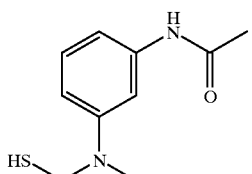

Compound (3)

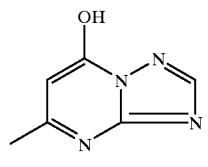

Compound (4)

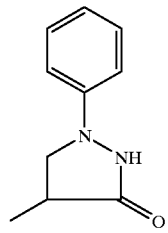

Compound (5)

Materials have been numbered from 1 to 4, material 1 representing a controll material (comparative material), wherein Emulsion A was coated in Material No. 1 without the compound according to the formula (IV.2) in the protective antistress layer, opposite to the Materials Nos. 2–4 (representing inventive materials) wherein amounts of compound (VI.2) added to the protective antistress were x=6, 12 and 18 mg per m2 respectively.

(VI.2)

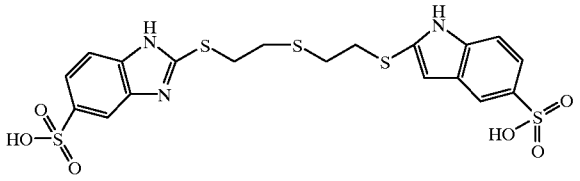

Samples of these coatings were exposed with green light of 540 nm during 0.1 seconds using a continuous wedge and-were processed.

The processing was run in the developer G138i and in the fixer G334, both trademarketed products from Agfa-Gevaert N. V., Mortsel, Belgium, followed by rinsing at the indicated temperature of 33° C. for a total processing time of 90 seconds in an automatic processing machine.

Following parameters are given in the Table 1:

Fog "F", given as an integer after having multiplied the real fog density as measured with a factor of 1000;

Speed "S", given as an integer after having multiplied the sensitivity measured at a density of 1.00 above minimum density as measured with a factor of 100; —an decrease of speed with a figure of 30 corresponding with a doubling in speed—;

Gradation (contrast) "GG", given as an integer after having multiplied with a factor of 100 the real gradation—contrast—figure as measured between a density of 1.0 and 2.0 above minimum density;

Covering power "CP", given as maximum density as measured after subtraction of the density of the suppport, multiplied with a factor of 100, further divided by the coating amount of silver, expressed as silver nitrate;

Image tone "IT", evaluated from figures corresponding with Dr, wherefore data are summarized with respect to the density Dr measured through a red filter at a blue density Db=2: the higher this value (figure multiplied by a factor of 100), the better (more desired blue-black instead of undesired red-brown) is the color of the developed silver.

TABLE 1

| Matl. No. | x mg cpd/m2 | F | S | GG | CP | IT |
|---|---|---|---|---|---|---|
| 1 (comp.) | 0 | 205 | 166 | 232 | 55 | 198 |
| 2 (inv.) | 6 | 199 | 166 | 244 | 58 | 198 |
| 3 (inv.) | 12 | 200 | 166 | 244 | 57 | 198 |
| 4 (inv.) | 18 | 202 | 168 | 241 | 57 | 199 |

As becomes clear from the Table 1 an increasing covering power without impairing speed and image tone can be obtained when increasing amounts of compound (VI.2) are added to the protective antistress layer of silver halide materials having {111} tabular silver bromoiodide grains.

Example 2

Preparation of Tabular Emulsion C

To a solution of 7.5 g of an oxidized gelatin in 1200 ml of demineralized water at 40° C., adjusted to a pH of 2.5 by adding H2SO4, stirred up to a rate of 500 rpm., further containing 20 mmole of KI, were added by a double jet method aqueous solutions of 2.94 M AgNO3 (hereinafter referred to as A1) and 2.94 M KBr (hereinafter referred to as B1): 6 ml of A1 and 1.9 ml of B1 were added in a time interval of 30 seconds. During this period, the reaction mixture was maintained at 40° C. When the addition was completed, stirring continued during 60 seconds and the temperature was increased up to 70° C. over a period of 40 minutes. Immediately thereafter a solution of 25 g of inert gelatin in 100 ml of demineralized water of 70° C. was added. 6 minutes later ultrafiltration was started on-line in order to reduce the volume in the reaction vessel and in the ultrafiltration unit up to 1500 ml per 500 g of AgNO3 present therein. By double-jet addition BI was added simultaneously with A1 (at a rate of 2.7 ml/min.) and B1 (at a rate of 2.71 ml/min.) during 2 minutes. In a further double jet addition A1 and B1 were added during 53 minutes and 45 seconds at a linearly increasing rate going from the initial rates mentioned herinbefore up to 9.90 ml/min. for A1 and up to 9.93 ml/min. for B1. B1 was replaced by B2 (aqueous solution, wherein 10.18 ml of an aqueous solution of KI (2.94 M) were added to a solution of 650 ml of KBr (2.94 M)). After 5 minutes A1 and B2 were further added by double-jet during 50 minutes and 23 seconds at rates increasing up to 15.40 ml/min. and 15.45 ml/min. respectively.

Ultrafiltration on-line was ended and the temperature was decreased up to 45° C., while stirring was dcreased to 200 rpm.. Washing during ultrafiltration (pressure 1.8 bar) was performed in order to obtain an end mV value (vs. sat. Ag/AgCl reference electrode) of +80 mV, concentrating the washed emulsion up to a volume of 690 ml per 500 g of AgNO3.

Peptisation was performed at 45° C. in order to obtain an emulsion having 250 g AgNO3 and 16.3 g of gelatin per kg.

The average grain size of the silver bromoioide tabular {111} emulsion grains (composed of 99.0 mole % of AgBr and 1 mole % AgI based on silver) thus prepared, expressed as equivalent volume diameter, was 0.60 $\mu$m, the average thickness was 0.23 $\mu$m.

To 3370 g of this emulsion, of which pH was adjusted to 5.5, were added consecutively 4 ml of a 10 wt. % KSCN solution, 0.2 ml of a 4.76×10−3 M solution of sodium toluenethio-sulphonate in methanol, 780 ml of a 0.25 wt. % solution of anhydro-5,5'-dichloro-3,3'-bis(n-propyl-3-sulphonate)-9-ethyl-benzoxa-carbocyanine triethylammonium salt, 5.5 mg sodium thiosulphate dissolved in 10 ml of demineralized water, followed 1 minute later by addition of 3 ml of a 0.001 wt. % solution of 2-carboxyethyl-N-benzothiazine selenide, 3 minutes later: 7.0 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole and this mixture was chemically ripened during about 4 hours at 50° C. in order to get the best fog-speed relationship afterwards after coating in a photographic material. After cooling,-phenol was added as a preservative.

After addition of the same coating solutions as for Emulsions A and B in Example 1 the emulsion was coated in the same way, just as for the Materials Nos 1–4 in Example 1.

In order to prepare the coating composition of the light-sensitive silver halide emulsion layer, a mixture of emulsions C and B (Emulsion B: see Example 1 hereinbefore) was made, wherein relative amounts, expressed as equivalent amounts of silver nitrate were combined in a ratio amount of 3:1, and wherein an average total amount of 6.2 g of silver nitrate per m2 were coated. So Emulsions C and B were coated in Materials Nos. 5–8, wherein differences between the materials as numbered herein were related with amounts of compound (III) added to the coating solutions of the protective antistress layer as indicated in Table 2, just as in Table 1 hereinbefore.

Samples of these coatings were exposed with green light of 540 nm during 0.1 seconds using a continuous wedge and were processed The processing was run in the developer G138i and in the fixer G334, both trademarketed products from Agfa-Gevaert N. V., Mortsel, Belgium, followed by rinsing at the indicated temperature of 33° C. for a total processing time of 90 seconds in an automatic processing machine.

Same sensitometric parameters were measured and summarized in the Table 2 hereinafter.

TABLE 2

| Matl | Y mg cpd (VI.2)/m2 | F | S | GG | CP | IT |
|---|---|---|---|---|---|---|
| 5 | 0 | 189 | 161 | 279 | 54 | 199 |
| 6 | 6 | 192 | 160 | 283 | 55 | 199 |
| 7 | 12 | 189 | 160 | 289 | 57 | 198 |
| 8 | 18 | 190 | 159 | 289 | 58 | 198 |

As becomes clear from the data given in Table 2 the same conclusions can be drawn as in Example 1: an increasing covering power without impairing speed and image tone can be obtained when increasing amounts of compound (III) are added to the protective antistress layer of silver halide materials having {111} tabular silver bromoiodide grain. Moreover contrast becomes enhanced, as could be derived already from the Table 1, inasmuch as fog was not increasing too much. An increased gradation further opens perspectives with respect to decreased coating amounts of silver in favour of ecology: so it has e.g. been established that the processed materials according to the present invention have an increased gradation in the highest densities, even in weak processing circumstances (as in an exhausted developer) which allows a reduction of amounts of coated silver halide of about 10%.

Example 3

Preparation of Tabular Emulsion D

To a solution of 6.9 g of an oxidized gelatin in 3 l of demineralized water at 51° C., adjusted to a pH of 2.5 by adding H2SO4, stirred up to a rate of 600 r.p.m., were added by a double jet method aqueous solutions of 0.98 M AgNO3 (hereinafter referred to as A1) and 0.98 M KBr (hereinafter referred to as B1): 25 ml of A1 and 25 ml of B1 were added in a time interval of 30 seconds. When the addition was completed, the temperature was increased up to 70° C. over a period of 30 minutes: UAg was controlled (expressed in mV versus a Ag/AgCl(sat.) reference electrode and should be in the range from 44.5±5 mV at a temperature of 70° C.±1° C. 1 minute later pH was set to a value of 5.0±0.3 and immediately thereafter a solution of 50 g of inert gelatin in 500 ml of demineralized water of 70° C. was added. 3 minutes later B1 was added at a rate of 7.06 ml/min. during 120 seconds, while simultaneously adding by double jet A1 at a rate of 7.5 ml/min.). In a further double jet addition A1 and B1 were added during 2822 seconds at a linearly increasing rate going from 7.0 up to 21.11 ml/min. for A1 and from 7.06 up to 21.29 ml/min. in order to maintain a constant UAg potential of +40 mV in the reaction vessel. After 5 minutes A1 and B1 were simultaneously added by double-jet addition during 60 seconds at a rate of 10.0 and 10.04 ml/min. respectively whereby the UAg value was held at a constant value of 50 mV while increasing the flow rate up to 46.49 ml/min. and 46.69 ml/min. respectively over a total time period of 81 min. and 5 seconds.

After that double-jet addition period, an amount of an emulsion having ultrafine (ca. 0.040 μm) 100% AgI crystals, dissolved in 20 g of demineralized water at 40° C., was added to the reaction vessel in order to get a total AgI content at the end of precipitation of 0.1 mole % vs. silver precipitated.

The average grain size of the silver bromoiodide tabular {111} emulsion grains thus prepared, expressed as equivalent volume diameter, was 0.53 μm, the average thickness was 0.12 μm.

After washing, gelatin and water were added in order to obtain a silver halide content of 230.5 g/kg, expressed as AgNO3, and a gelatin content of 72.6 g/kg. To the emulsion having a weight of 3442 g, the pH of which was adjusted to 5.5, and to 344.2 g thereof was added consecutively 4 ml of a 1 wt. % KSCN solution, 50 mg (0.4 wt % solution, dissolved in 18 ml of methanol), of the azacyanine dye corresponding with the formula given hereinafter,

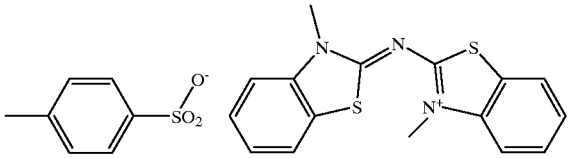

followed by addition, after 5 minutes of 2 ml of a 4.76×10−5 M solution of sodium toluenethiosulphonate in methanol, further followed by addition after 5 minutes of 1200 ml of a 0.25 wt. % solution of anhydro-5,5'-dichloro-3,3'-bis(n-propyl-3-sulphonate)-9-ethyl-benzoxa-carbocyanine triethylammonium salt, 5 mg of sodium thiosulphate dissolved in 10 ml of demineralized water at 35° C., 7 ml of a 0.001 wt. % solution of 2-carboxyethyl-N-benzothiazine selenide, 12 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole.

The emulsion sample was chemically ripened at 50° C. during a time in order to get the best compromise between fog and sensitivity. After cooling phenol was added as a preservative.

Coatings were made in the same way as in Example 1, as well as exposure of the Material 13 (comparative) and Material 14 (inventive), the only difference being addition to the protective antistress layer of compound (VI.2) in an amount of 18.4 mg/m2.

Processing proceeded in the same way as in Example 1 (G138i/G334i) after having preserved the material for 12 days at a temperature of 45° C. and a relative humidity of 70%.

Besides the results obtained for fog, speed and contrast GG, as well as differences between preserved materials and freshly coated materials (values) the density latitude DLT (=DMAX−DMIN) has also been given in the Table 3.

TABLE 3

| Matl. No. | Comp. (VI.2) mg cpd/m2 | F | S | GG | DLT | ΔF | ΔS | ΔGG | IT |
|---|---|---|---|---|---|---|---|---|---|
| 13 (comp.) | 0 | 214 | 152 | 162 | 357 | 12 | 5 | 9 | 196 |
| 14(inv.) | 12 | 218 | 154 | 162 | 374 | 11 | 3 | 11 | 199 |

For a similar sensitometry, an improved image tone was obtained and preservation was certainly not negatively influenced. Moreover the material according to the present invention was showing an increased density latitude.

Both materials Nos. 13 and 14 were further processed after the same exposure in a weak hydroquinone developer, the composition of which has been given hereinafter in Table 4, and further fixed in the same G334 fixer.

TABLE 4

| Weak developer H2Q (pH set at 10.0 ± 0.1) | |
|---|---|
| Hydroquinone | 13.3 g/l |
| Phenidone | 0.8 g/l |
| Sodium metabisulphite EDTA Na4-salt.3aq | 29.7 g/l |
| Potassium hydroxyde | 1.33 g/l |
| Sodium tetraborate.10 aq. | 27.9 g/l |
| Acetic acid | 8.8 g/l |
| 5-methyl benzotriazole | 5.2 g/l |
| 5-nitrobenzimidazole | 0.04 g/l |
| glutardialdehyde | 0.05 g/l |
| diethylene glycol | 12.8 g/l |

Differences obtained in the two processing cycles have been given in the Table 5 hereinafter for fog F, speed S, contrast in the linear (GG) and shoulder (GGS) densities, as well as for the density latitude DLT.

TABLE 5

Sensitometric differences between G13Bi and weak developer.

| Matl. No. | Comp. (VI.2) mg cpd/m2 | ΔF | ΔS | ΔGG | ΔGS | ΔDLT |
|---|---|---|---|---|---|---|
| 13 (comp.) | 0 | −2 | +3 | −5 | −27 | −44 |
| 14 (inv.) | 12 | 0 | +1 | −4 | −8 | −21 |

As can be concluded from the data given in Table 5 the material according to the present invention is more stable with respect to differing processing conditions (see especially the lower decrease of the shoulder gradation and the density latitude).

Having described in detail preferred embodiments of the current invention in the Examples hereinbefore, it will now be apparent to those skilled in the art that numerous modifications can be made therein without departing from the scope of the invention as defined in the following claims.

What is claimed is:

1. Black-and-white silver halide photographic film material comprising a transparent film support having first and second major surfaces coated with a subbing layer, further coated adjacent thereto on one side (for a single-side coated material) or on both sides (for a duplitized material) of said film support, optionally in contact with a hydrophilic undercoat layer, and overcoated with a protective antistress layer, a light-sensitive silver halide emulsion layer having chemically and spectrally sensitized {111} tabular hexagonal grains, accounting for at least 50% of the total projective surface of all grains, with a mean equivalent volume diameter of from 0.3 μm up to 1.0 μm and an average grain thickness of less than 0.30 μm, wherein said film material is coated with a total amount of silver, expressed as an equivalent amount of silver nitrate of less than 7 g/m2, characterized in that said protective antistress layer(s) and/or said hydrophilic undercoat layer comprise(s) a compound according to general formula (I) in an amount of at least 0.5 mmole per mole of silver halide coated, (I)

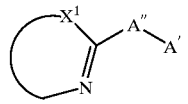

wherein A" represents a divalent linking moiety selected from the group consisting of an arylene, hetero-arylene, alkylene, alkenylene and alkynylene chain, wherein each of said arylene, heteroarylene, alkylene, alkenylene and alkynylene chain optionally contains heteroatoms, aliphatic or aromatic rings, and alkali soluble groups; X1 represents atoms necessary to form a five- or six-membered aromatic or heterocyclic ring; and wherein A' is represented by a functional group, represented by formula (II)

(II)

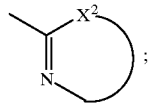

wherein X2 represents atoms necessary to form a five- or six-membered aromatic or heterocyclic ring.

2. Material according to claim 1, wherein in formula (I) A" is represented by the formula (III)

$$Y'—Ca-Z—Cb-n-Y'm \quad \text{(III)}$$

wherein m equals 0 or 1;

n is equal to 0, or is an integer having a value from 1 to 6;

Y' represents one of S, CR1R2 and NR3, with R1–R3 representing an alkyl, aryl or aralkyl and wherein R1 and R2 may form an alicyclic, heterocyclic or aromatic ring;

Z represents O, S, CR7R8, N; or a divalent linking moiety selected from the group consisting of an alkylene, alkenylene and alkynylene chain, wherein each of said alkylene, alkenylene and alkynylene chain optionally contains heteroatoms, aliphatic or aromatic rings, and alkali soluble groups;

Ca and Cb each independently represents an aliphatic carbon chain, wherein a and b are equal to 0, or are represented by an integer having a value from 1 to 5.

3. Material according to claim 2, wherein in formula (III) each of a and b independently represents an integer having a value of 2 or 3.

4. Material according to claim 1, wherein in formulae (I) and (II) said five- or six-membered ring is substituted with at least one alkali soluble group.

5. Material according to claim 2, wherein said compound (III) is represented by formula (IV)

(IV)

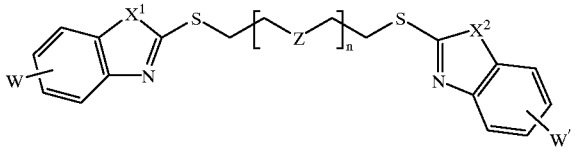

wherein W and W' each represents same or different groups, being an alkali soluble group or a substituent having an alkali soluble group.

6. Material according to claim 5, wherein said alkali soluble group is an acidic group selected from carboxylic acid, sulphonic acid and phosphonic acid.

7. Material according to claim 1, wherein said compound is present in an amount of at least 1 mmole up to 5 mmole per mole of coated silver halide.

8. Material according to claim 1, wherein the chemically and spectrally sensitized {111} tabular hexagonal grains have an average grain thickness of from 0.05 up to 0.25 $\mu$m.

9. Material according to claim 1, wherein the chemically and spectrally sensitized {111} tabular hexagonal grains have a composition wherein silver iodide is present in an amount of less than 3.0 mole % of iodide based on silver.

10. Material according to claim 1, wherein said light-sensitive silver halide emulsion layer comprises an azacyanine compound.

11. Material according to claim 1, wherein said grains have been made sensitive to the ultraviolet/blue and/or green range of the wavelength spectrum.

12. Radiographic screen/film system or combination comprising a single-side coated or a duplitized film according to claim 1, in contact with one screen or sandwiched between a pair of supported or self-supporting X-ray intensifying screens, wherein said one screen or said pair of supported or self-supporting X-ray intensifying screens comprise(s) luminescent phosphor particles emitting at least 50% of their emitted radiation in the wavelength range for which said material has been made spectrally sensitive.

* * * * *